United States Patent [19]

Young

[11] 4,086,042

[45] Apr. 25, 1978

[54] ROTARY COMPRESSOR AND VANE ASSEMBLY THEREFOR

[75] Inventor: Robert R. Young, Franklin Borough, Pa.

[73] Assignee: Westinghouse Electric Corporation, Pittsburgh, Pa.

[21] Appl. No.: 697,099

[22] Filed: Jun. 17, 1976

[51] Int. Cl.[2] ..... F01C 19/04; F01C 1/00; F04C 27/00

[52] U.S. Cl. ..... 418/139; 418/147; 418/248; 418/249

[58] Field of Search ..... 418/139, 147, 148, 248, 418/249, 266–268

[56] References Cited

U.S. PATENT DOCUMENTS

| | | | |
|---|---|---|---|
| 348,879 | 9/1886 | Austin | 418/147 |
| 656,694 | 8/1900 | Evans | 418/139 |
| 694,333 | 2/1902 | Szabo | 418/139 |
| 936,543 | 10/1909 | Kinney | 418/139 |
| 1,339,347 | 5/1920 | Jackson | 418/147 |
| 1,361,343 | 12/1920 | Marion | 418/139 |
| 1,658,524 | 2/1928 | Gurley | 418/268 |
| 2,937,715 | 5/1960 | Jackson et al. | 418/249 |
| 3,107,846 | 10/1963 | Mihalakis | 418/139 |
| 3,647,328 | 3/1972 | Fox | 418/147 |

FOREIGN PATENT DOCUMENTS

| | | | |
|---|---|---|---|
| 687,573 | 2/1940 | Germany | 418/148 |

*Primary Examiner*—John J. Vrablik
*Attorney, Agent, or Firm*—E. C. Arenz

[57] ABSTRACT

A rotary compressor is provided in which the space between the rotor and the encompassing housing wall is separated into suction and discharge spaces by reciprocating vane assemblies, each of which includes a blade portion having a distal end portion carrying a pivotal shoe, the joint between the shoe and blade being of cylinder and socket character with the blade end forming the cylinder part of the joint and the shoe having a socket cavity for receiving the cylinder. In other forms, the shoe has a generally channel shape in transverse cross section with the leg of the channel facing the compression side having vent holes which reduces the turning movement applied to the shoe under conditions of high differential pressures between one side of the shoe and the other. This arrangement promotes stability and reduces the possibility of loss of equilibrium of the shoe against the moving surface.

6 Claims, 6 Drawing Figures

ROTARY COMPRESSOR AND VANE ASSEMBLY THEREFOR

CROSS REFERENCE TO RELATED APPLICATIONS

Young-Riffe U.S. Pat. application Ser. No. 697,164, filed June 17, 1976 is a related application.

BACKGROUND OF THE INVENTION

1. Field of the Invention

The invention pertains to the art of rotary compressors and in particular to vane assemblies therefor.

2. Description of the Prior Art

The provision of vane assemblies which include a blade portion and a pivotal shoe portion on the distal edge of the blade in rotary devices such as pumps, engines and compressors is known as evidenced by U.S. Pat. Nos. 40,008; 832,848; 856,739; 2,458,620; and 3,193,192. In each of these patents there is disclosed a vane assembly with a blade and shoe joined in a cylinder and socket type joint. However, in each case the cylinder portion of the joint is provided in the shoe and the socket portion is provided in the edge of the blade. In all of the arrangements except U.S. Pat. No. 2,458,620, the part of the shoe which bears against a surface with which there is relative velocity is separated from the cylindrical portion of the shoe by a neck. In such arrangements it is possible for the bearing part of the shoe to be provided with an extended surface in a transverse direction which has both advantages and disadvantages in respects which will be detailed later.

In the case of the other patent, the shoe is semi-cylindrical in cross section with the rounded portion fitting within the socket at the edge of the vane, and the flattened portion having a curvature stated to correspond to the curvature of the main cylinder wall. While this arrangement may be advantageous in reducing turning moments tending toward instability, the arrangement also precludes the use of an extended surface in a transverse direction, which is beneficial with respect to obtaining a hydrodynamic lubricating film between the shoe and the surface against which it bears and which has relative movement.

It is the aim of this invention to provide a rotary compressor having an improved vane assembly of the blade and shoe type. The improvement resides largely in the provision of a structure which promotes attaining a good hydrodynamic lubricating film between the shoe surface and the surface with which there is relative movement. The attainment of this hydrodynamic film through the particular structure of this invention is due in part at least to the structure being of a character in which the turning moment applied to the shoe is reduced relative to the moments applied to the prior art shoes.

It is believed that a better understanding of the invention will be gained if some basic geometric phenomena as related to hydrodynamic films is understood. The purpose of the presence of a good hydrodynamic film is of course to give good lubrication between relatively moving parts. The quality of lubrication obtained is in part at least a function of the area extent of the hydrodynamic film present. Thus, a pair of completely flat opposed surfaces with a hydrodynamic film between will provide the maximum lubricating quality. The lubricating quality is reduced if one of the surfaces has a radius, and to the extent that the radius becomes smaller and smaller, the quality of the lubrication is further reduced. Also, two curved surfaces are inferior to one flat and one curved surface having the same radius as the two curved surfaces. To the extent the radii decrease, the quality of lubrication is correspondingly reduced.

Another factor which bears on the quality of the hydrodynamic film is the load which is imposed upon the two facing surfaces between which relative movement exists. Thus, to the extent that the load may be reduced while still maintaining an adequate seal, this is a preferable arrangement. Since a component of the load with a sliding shoe arrangement of any type includes the moment tending to pivot the shoe, an arrangement in which the moment is kept to the minimum reasonable value is preferable.

A feature of the invention is the provision of a structure in which the moment is reduced relative to the prior art structures without sacrificing the disadvantage of a reduced area of shoe sliding surface.

SUMMARY OF THE INVENTION

In accordance with the invention in its broader aspect, a rotary compressor is provided with a housing and a rotor member therein, the rotor member having a transverse area less than the transverse area of the chamber formed by the housing to provide space within the chamber in which the suction and compression in the compressor occurs. At least one vane assembly is provided which is reciprocable relative to at least one of the rotor and the housing. The vane assembly end portion bears against the relatively moving surface of either the rotor or the housing depending upon which of these elements is carrying the vane assembly. The vane assembly comprises a blade portion and a pivotal shoe carried at the distal end portion of the vane by the blade portion. The joint between the shoe and blade is of cylinder and socket character with the end edge of the blade being the cylindrical part and with the shoe having the socket part.

In one form of the invention, the shoe has the general shape of a channel with the marginal edges of the legs of the channel being shaped to hold the shoe on the cylindrical portion of the blade, and with the leg of the channel which is on the side presented to the compression space in the compressor being provided with openings to place the interior of the channel in communication with the compression space. This form of shoe may be made by stamping the shoe out of sheet steel.

With the arrangement according to the invention, the moment applied to the shoe in a direction to pivot it to increase the angle opening to the suction side between the bearing face of the shoe and the relatively moving opposite face is reduced relative to the moments experienced with the prior art arrangements.

In other forms of the invention, the shoe is shaped to reduce the clearance volume by fitting closely into the vane slot space at top center positions of the rotor.

DRAWING DESCRIPTION

Figure 3:
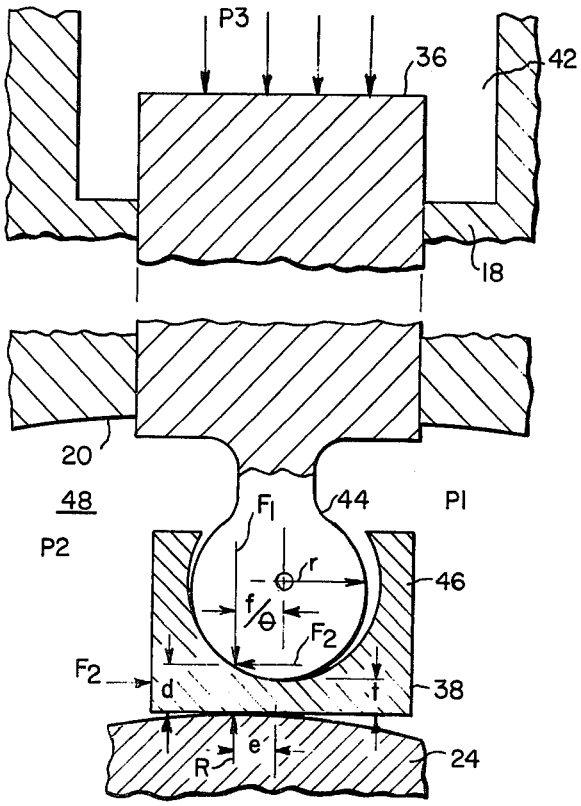
FIG. 3 is a partly schematic and broken sectional representation of a vane assembly of one form according to the invention and includes dimensional and force notations.
Figure 4:
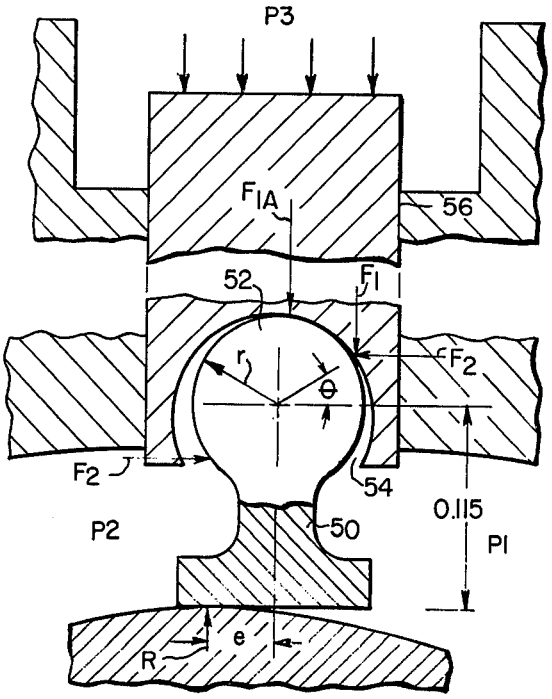
FIG. 4 PRIOR ART
Figure 5:
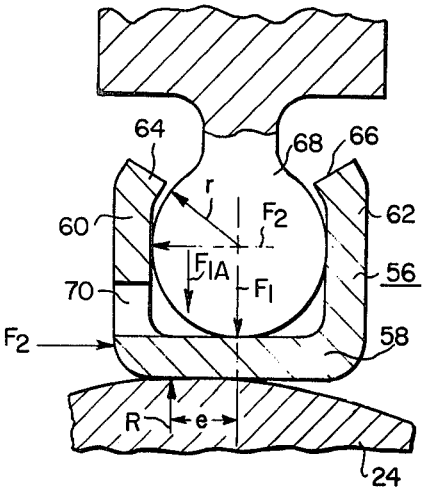
Figure 6:
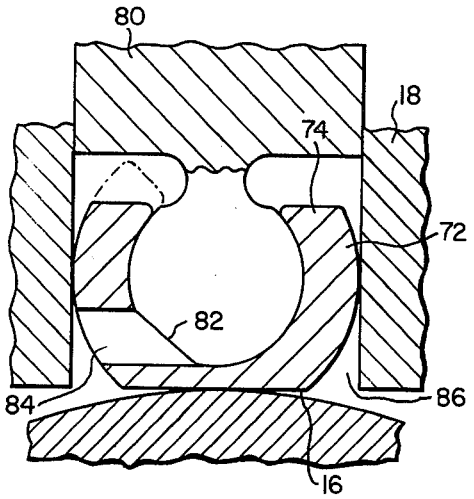

FIG. 4 is a partly schematic and broken sectional representation of a vane assembly according to the prior art such as in U.S. Pat. No. 3,193,192 and also includes force and dimensional notations for the purpose of understanding the comparisons made between the structures of FIGS. 3 and 4;

FIG. 5 is a sectional view of the shoe and blade joint formed when the shoe takes a channel form; and FIG. 6 is a sectional view of another form the shoe and blade may take.

DESCRIPTION OF THE PREFERRED EMBODIMENTS

One type of rotary compressor in which the invention may be incorporated, and used as an example for this description, is one in which the rotor portion of the compressor is of elliptical form in cross section with the rotor being rotated within a circular chamber. It is to be understood that the vane assembly of the invention is not limited to such an application, but may be used in other types of rotaries such as the rolling piston type or the rotating vane type, regardless of whether the rotor is of elliptical or other various shapes and regardless of the shape of the chamber encompassing the rotor. Also, the vanes may be carried by the rotor as in the rotating vane type of compressor so that rather than the vanes retracting outwardly into the housing whose walls define the chamber, the vanes would of course retract inwardly into the rotor. However, as is well known to those versed in this art, the necessity and desirability of providing a vane type structure which has a low coefficient of friction is not a significant factor in the rolling piston type of rotary where the piston in effect walks around the interior of the chamber with a low relative velocity between the piston surface and the vane surface.

Figure 1:
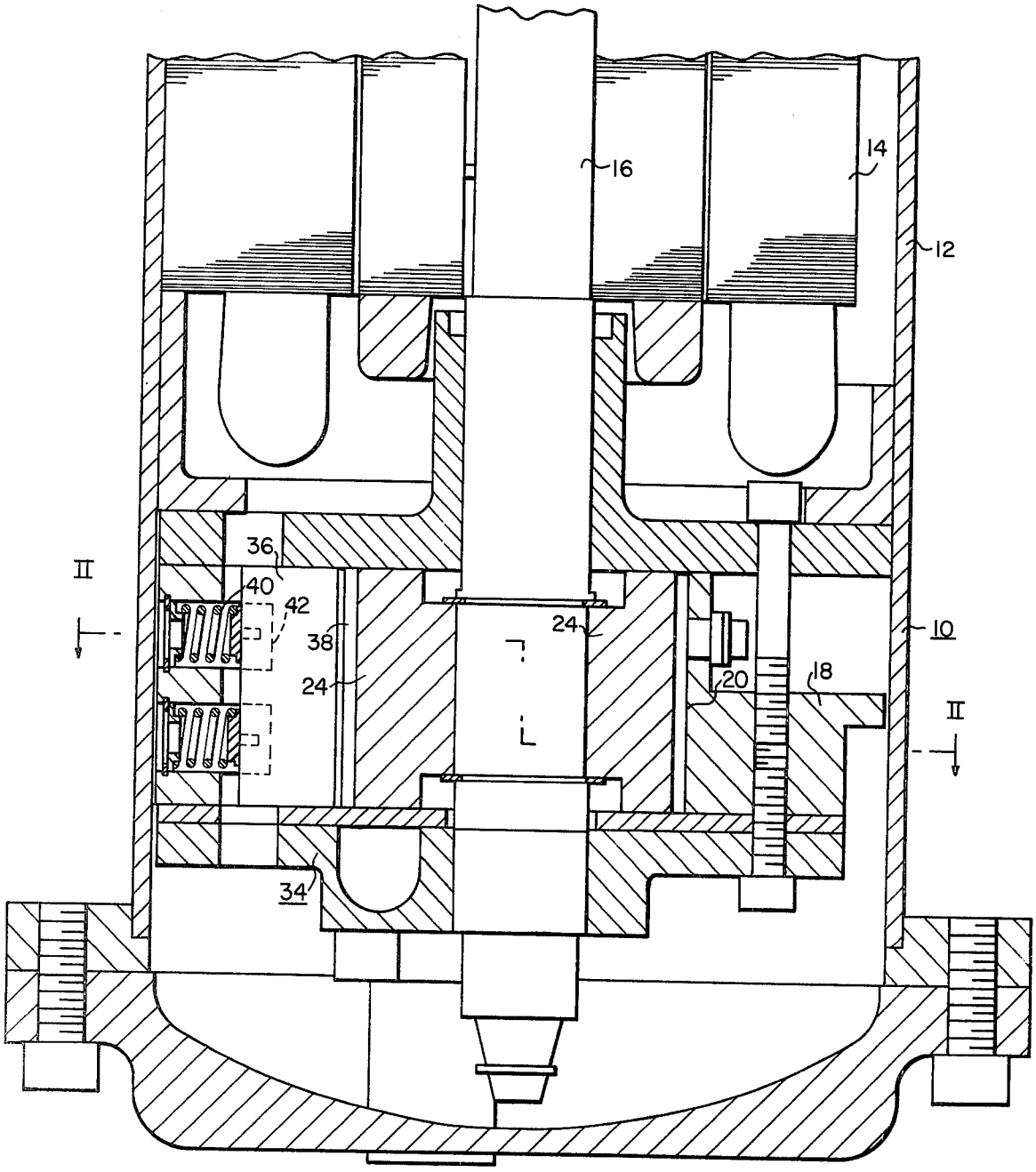
FIG. 1 is a fragmentary vertical sectional view of a hermetic rotary compressor corresponding to a view taken along the line I—I of FIG. 2.
Figure 2:
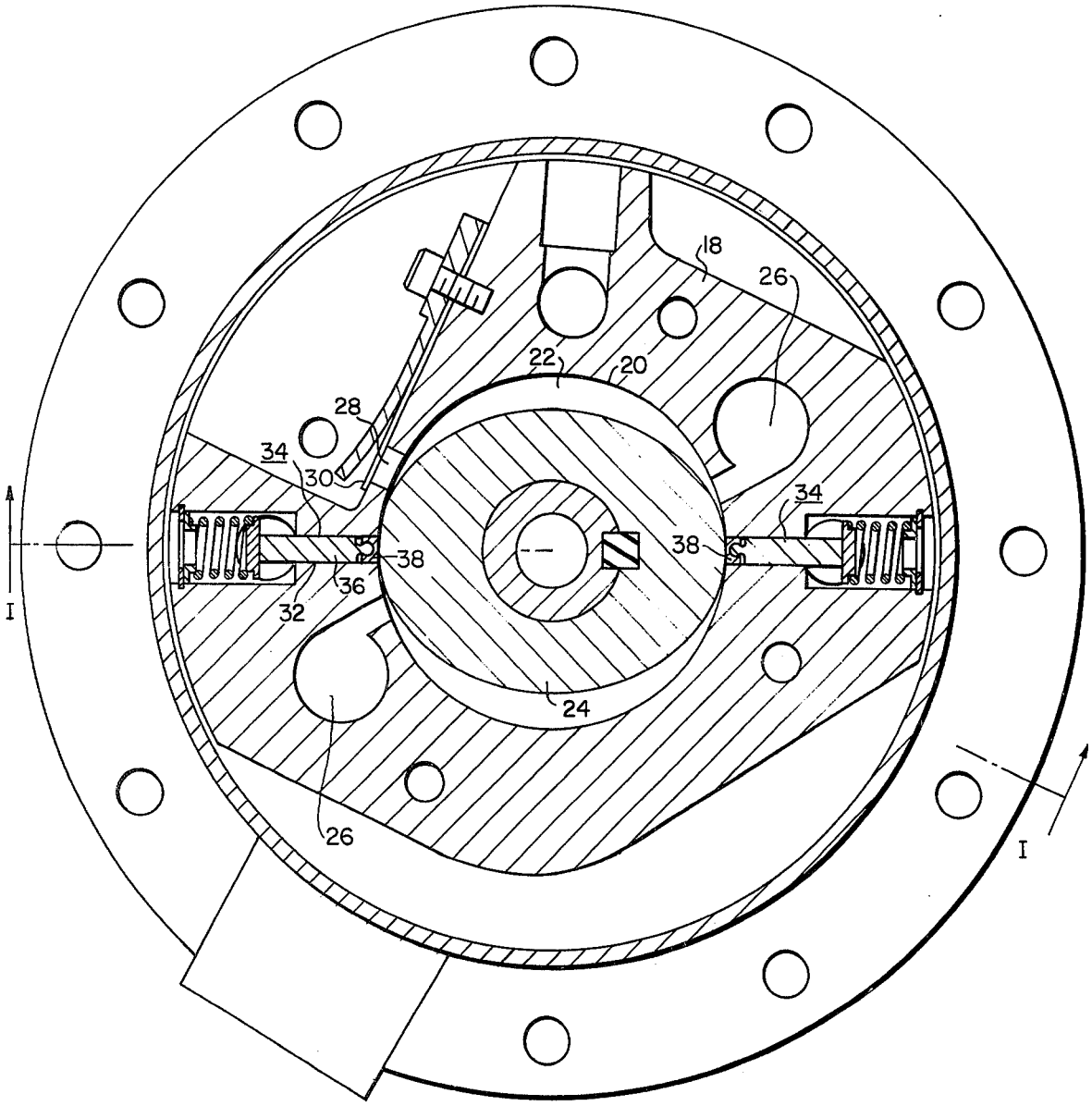
FIG. 2 is an offset horizontal section corresponding to one taken along the line II—II of FIG. 1.

Referring now to FIGS. 1 and 2, in the illustrative embodiment the rotary compressor generally designated 10 is provided in the bottom portion of a hermetic can 12 which carries an electric motor 14 in its upper portion for driving the rotary compressor through the central shaft 16.

The housing 18 has interior cylindrical walls 20 forming the chamber 22 into which the rotor 24, which is elliptically shaped in transverse cross section, is received. The major crosswise dimension of the rotor corresponds closely to the diameter of the cylindrical chamber while the minor crosswise dimension is considerably less to form with the cylindrical walls of the chamber the spaces within which the suction and compression occur as the rotor rotates.

The housing has formed in it the usual suction gas inlets and ports 26 (two of which are shown in FIG. 2) and discharge ports 28 (only one of which is seen in FIG. 2 because of the offset section). A discharge valve 30 may be provided for each of the discharge ports 28.

The housing 18 is provided at diametrically opposite points with a pair of slots 32 which extend for the length of the housing. These slots receive the vane assemblies generally designated 34 which basically comprise a blade portion 36 and a shoe portion 38. Compression springs 40 are provided in two radially extending bores 42 at the outer ends of the blades 36. These springs bias the vane assemblies radially inwardly to press the shoes against the periphery of the rotor 24 while the compressor is at rest. However, the major biasing force when the compressor is operating is obtained from the interior of the can 12 being at high side or condenser pressure which is communicated to the bores 42 and which urge the vane assemblies radially inwardly. As the rotor 24 turns, the vane assemblies reciprocate back and forth to follow the changing radius of the periphery of the elliptical rotor. As such, the vanes separate each of the two spaces defined between the flattened sides of the rotor and the cylindrical wall 20 of the housing into suction and discharge spaces, as in any conventional rotary compressor with reciprocating vanes.

Referring to FIG. 3, the end edge portion of the blade 36 which reciprocates in and out of the slot within which the blade is slidably held, and which end edge is referred to as the distal end has a semi-cylindrical shape in transverse cross section as shown and carries the numeral 44. The shoe 38 has a cavity in transverse cross section forming the socket which cooperates with the cylinder 44 and provides the pivotal socket joint. The bore forming the socket may be machined in the shoe 38 illustrated. It will be noted that the diameter of the socket shown is greater than, and is exaggerated relative to, the diameter of the cylinder 44 for the purpose of showing the concentration of force upon the parts.

In FIG. 3, the rotor 24 is assumed to rotate in a clockwise direction, with the space 46 to the right of the vane assembly and carrying the indication $P_1$ being at suction pressure, the space 48 to the left of the vane assembly and carrying the legend $P_2$ having pressures varying from suction to discharge, and the space in the bore 42 into which the proximal end of the vane projects carrying the legend $P_3$ being at high side or condenser pressure. As the elliptical rotor 24 rotates, the pressure $P_2$ in space 48 will vary while the pressures $P_1$ in space 46 and $P_3$ in the bore 42 will remain substantially constant. Additionally, the curvature of the surface of the rotor will change continuously from the relatively flatter surfaces on the large radiused sides of the rotor to the relatively sharper curvature surfaces on the ends of the major diameter of the rotor. As a result of the changing differential pressures and the changing curvature of the surfaces the shoe 38 will pivot about the axis 0 at the center of the cylinder 44 of the vane.

For promoting an understanding of the advantages of the structural arrangement of FIG. 3 over that of the prior art arrangement of FIG. 4, an analysis of the forces acting upon the parts is considered desirable.

The following notations are defined for the purpose of the calculations which will follow. The determination of the magnitude of *e*, the moment arm for the reaction force R, is the desired end result since that value has a significant effect upon the quality of hydrodynamic film which can be achieved. Following the definition of the notations, values for the calculations for FIG. 3 are set forth.

$F_1$ = downward force per inch of vane length.
$F_2$ = sideways force per inch of vane length.
R = upward force (reaction force) per inch of vane length.
$P_1$ = suction space pressure.
$P_2$ = compression space pressure.
$P_3$ = condenser pressure.
W = thickness of blade.
$r$ = radius of cylinder 44.
$d$ = height of area to which sideways force is applied to calculate moment.
$e$ = moment arm for reaction force R.
$f$ = moment arm for downward force F (same as $r \sin \theta$).

$\theta$ = angle between centerline of blade, and a line intersecting both 0 and center of contact area between cylinder and socket.

Values For Calculations For FIG. 3

| | | | |
|---|---|---|---|
| $P_1$ | = | 0 psig | |
| $P_2$ | = | 220 psig | $(1.52 \times 10^6$ Pa) |
| $P_3$ | = | 200 psig | $(1.38 \times 10^6$ Pa) |
| r | = | 0.055" | $(1.40 \times 10^{-3}$m) |
| W | = | 0.188" | $(4.76 \times 10^{-3}$ m) |
| d | = | 0.030" | $(6.45 \times 10^{-4}$ m) |
| f | = | 0.017" | $(4.31 \times 10^{-4}$ m) |
| $\theta$ | = | 18° | |

The downward pressure force $F_1$ on the vane per inch of its length is calculated according to the following Equation (1):

$$F_1 = \left(\frac{W}{2} + f\right)(P_3 - P_1) \pm \left(\frac{W}{2} - f\right)(P_3 - P_2) \quad (1)$$
$$= (0.094 + 0.17)(200) - (0.094 - 0.17)(20)$$
$$= 20.16 \text{ lbs. } (9.4 \text{ kg})$$

The upward reaction force will of course be equal to $F_1$. The point during the rotation of the rotor 24 which has been selected for the calculation is that which occurs near the end of the compression at which time the pressure in the discharge pressure space will exceed that of the condenser. At that point during the cycle the negative sign is used in Equation (1) because of the lift provided on the left side of the vane due to the higher discharge than condenser pressure.

The sideways force $F_2$ per inch of the vane length due to the pressure differential between $P_2$ and $P_1$ is calculated from Equation (2) as follows:

$$F_2 = (P_2 - P_1)(d) \quad (2)$$
$$= 220\ (0.030)$$
$$= 6.6 \text{ lbs.} - (3.0 \text{ kg})$$

This force of 6.6 lbs. (3.0 kg) is applied in a rightward direction as indicated in FIG. 3 to the center of the area denoted by the dimension *d*, and of course is also applied to the left as indicated by leftward directed arrow $F_2$ at the center of the contacting area between the cylinder 44 and shoe 38.

In that connection, it is noted that the determination of the values of *d*, *f* and angle $\theta$ is accomplished through an iterative process since the dimensions *d* and *f* are functions of the angle $\theta$. Thus the values for *d*, *f* and angle $\theta$ set forth herein are those which were arrived at through such a process and which are very close to being correct relative to each other. The tangent of the angle $\theta$ is equal to $F_2/F_1$.

Equation (3) below states the condition of equality of the opposing turning moments at any given point of time upon the shoe tending to turn it upon the cylinder. The products of the factors on the left side of the Equation are those which tend to rotate the shoe in a counterclockwise direction, while the product on the right side of the Equation is the opposing moment which balances the counterclockwise force.

$$(F_1 f) + (F_2)(d/2) = \text{Re} \quad (3)$$
$$(20.6)(0.017) + (6.6)(0.015) = (20.6)\, e$$
$$e = (0.449/206)$$
$$= 0.022 \text{ inch} - (5.6 \times 10^{-4} \text{ m})$$

Thus it will be seen that the value of *e* is relatively small and indicates that the reaction force R upwardly is relatively close to the vertical centerline passing through the axis of the cylinder in FIG. 3. This also indicates that the turning moment on the vane shoe is relatively low, this resulting in part at least at this point in the cycle because the point of force application of $F_2$ is relatively close to the contact surface of the shoe. This relatively low turning moment provides a situation where the entrance opening to the space between the shoe surface and rotary periphery is more open and this promotes the development of a good hydrodynamic lubricant film. A small *e* dimension also indicates a condition of more stability of the shoe relative to the rotor than would be the case if *e* were considerably larger.

The calculations and analysis which have proceeded in connection with FIG. 3 are only for a given point in time at which the discharge pressure is approaching its maximum. It will be appreciated that depending upon the changing differential pressures between the discharge space and the suction space that the shoe will in fact oscillate upon the cylinder as the rotor turns. This also means that the angle $\theta$ will change accordingly and the *f*, *d*, and *e* values will accordingly change. The selection of the values at a time when the discharge pressure is approaching maximum have been used for the example because that condition corresponds to the most adverse condition for maintaining a good hydrodynamic lubricating film, and also corresponds to conditions approaching an unstable situation of the shoe on the cylinder, as will be explained hereinafter.

Referring now to FIG. 4, which illustrates the prior art arrangement which will be compared to that of the invention, in this case the shoe 50 includes the cylinder 52 as an integral part of the shoe, and the socket 54 is formed in the edge of the blade 56. The same pressure values used in connection with FIG. 3 are used for the analysis of FIG. 4. Also, certain dimensions of the structure of FIG. 4, such as the radius of the cylinder and socket, are the same as for FIG. 3. However, because of the cylinder and socket relationship being effectively reversed in FIG. 4, a typical dimension of 0.115 inches $(2.9 \times 10^{-3}$m) from the center of the cylinder 52 to the surface of the shoe which bears against the rotor is selected. Also, because of the reversal of structure, the center of the area of contact between the socket and cylinder is at the right-hand side of the cylinder in FIG. 4 and in the example to follow is slightly above a horizontal line of FIG. 4 passing through the center of the cylinder. As in the case of the calculations with respect to FIG. 3, the angle $\theta$ for FIG. 4 has been determined through an iterative process and is about 10°.

The forces $F_1$, $F_{1A}$ and $F_2$ are calculated in accordance with the Equations (4)–(6) set forth below. It will be appreciated that the upward force R will be equal to the total of the two downward force $F_1$ and $F_{1A}$.

$$F_1 = \left(\frac{W}{2} - r\cos\theta\right)(P_3 - P_1) - \left(\frac{W}{2} + r\cos\theta\right)(P_2 - P_3) \quad (4)$$
$$= (0.094 - 0.054)(200) - (0.094 + 0.054)(20)$$
$$= 5.04 \text{ lbs.} \quad (2.3 \text{ kg})$$

$$F_{1A} = (e + r\cos\theta)(P_2 - P_1) \quad (5)$$
$$= (0.05 + 0.054)(220)$$
$$= 22.9 \text{ lbs.} \quad (10.4 \text{ kg})$$

$$F_2 = (0.115 + rsm\,\theta)(P_2 - P_1) \quad (6)$$
$$= (0.115 + 0.0094)(220)$$

-continued $= 27.4$ lbs. (12.4 kg)

Since the sum of the moments about the axis 0 of the ball at any given point in time equals zero, the value of *e*, that is, the eccentricity, may be calculated by the use of equation (7) below which is also solved.

$$F_2\left(\frac{0.115 + r\sin\theta}{2} - r\sin\theta\right) + F_2(r\sin\theta) - F_1(r\cos\theta) - F_{1A}\left(\frac{e + r\cos\theta}{2} - e\right)(F_1 + F_{1A})e = 0 \quad (7)$$

$$(27.4)\frac{0.115 + 0.009}{2} - 0.009) + (27.4)(0.0094) - (5.04(0.054) - (22.9)\frac{0.050 + 0.054}{2} - 0.050) - (5.04 + 22.9)e = 0$$

$$1.45 + 0.258 - 0.27 - 0.046 - 27.94e = 0$$

$$e = 0.0498'' \quad (1.26 \times 10^{-3}\,m)$$

From the foregoing it will be seen that the value of *e* for a structure according to the prior art of FIG. 4 is over twice the value of *e* in the structure of FIG. 3, according to the invention. There are several disadvantages to having this greater eccentricity in the prior art structure. First, to the extent that the opening space at the leading edge of the shoe surface relative to the rotor is restricted, the entrance opening for lubricant to be received between the two parts is restricted. Secondly, the value of *e* for the FIG. 4 arrangement is nearly equal to the radius of the cylinder. Under a liquid slugging condition in which the pressure in the discharge space will rise well above the 220 psig, a situation occurs in which the eccentricity exceeds the value of half of the width of the sliding surface of the shoe. In this case, the shoe will tip to a position in which the corner of the surface is riding upon the periphery of the rotor.

The calculations have also shown that the load and reaction force of the FIG. 4 arrangement is about 28 lbs. as contrasted to the approximate 20 lbs. of FIG. 3. Because of the load being greater, the friction between the shoe and rotor in FIG. 4 correspondingly must be greater than that of the FIG. 3 arrangement.

Another point of significance in connection with the prior art arrangement of FIG. 4 is that the angle $\theta$ is only a few degrees removed from a line which is parallel to a tangent to the surface of the rotor. With significantly higher pressure differentials such as may occur during periods of liquid slugging, in which the pressure differential between the pressure and the compression space and the suction space will far exceed, say, 250 psig, it is possible for the center of the area of contact between the cylinder 54 and the socket 52 to move downwardly (as seen in FIG. 4) so that the forces are such that the blade 56 can tend to lift from the shoe 50 while the shoe 50 remains pressed downwardly against the periphery of the rotor. Under these conditions, there is a tendency to instability of the shoe 50 relative to the blade and it may rotate in a counterclockwise direction as seen in FIG. 4.

As previously noted, the quality of the hydrodynamic lubricating film is a function of the extent of the surface areas which are relatively close to each other. Thus, if the shoe 50 tips to a position in which the corner of the surface is riding upon the periphery of the rotor, the hydrodynamic film is basically lost.

The type of shoe 38 illustrated in FIG. 3 may be formed of cast iron in which the socket part is machined out along the length of the shoe. FIG. 5 shows the cross section of a different type of shoe 56 which may be formed of sheet steel through stamping operations to form it into the generally channel-shape in transverse section and includes a web portion 58, opposite leg portions 60 and 62, each of the leg portions including marginal edge portions 64 and 66 which are spaced apart less than the diameter of the cylinder 68 to hold the shoe in captured relation on the cylinder. The leg 60 facing the compression space has a series of vent openings 70 to place the interior quadrant of the space inside the channel closest to the compression space in communication therewith. The result of this is that the force $F_2$ to the right as shown in FIG. 5, and which is a function of the pressure differential between the compression and suction sides of the shoe, is considerably less than if this area opened by the vent openings 70 were not opened. That is, the force is a function of the area of the shoe over which the pressure differential exists, and by opening up the spaces with the vent opening 70 this area is significantly reduced. To insure an understanding of this, the following is noted. The vent openings 70 are always open. The reduction in the force $F_2$ with the vent openings 70 of FIG. 5, as contrasted to having a higher force $F_2$ if these vent openings did not exist, has to do with the reduction of the area of the shoe against which the compression pressure operates. The matter of concern is not whether this sideways acting pressure from the compression space acts on a total area which is the same in both cases, but rather the effect of the forces in creating a moment which tends to turn the shoe around the cylinder 68. Thus, with the reduction of the area of the shoe against which the compression pressure is acting, there is a reduction in the moment tending to turn the shoe around the cylinder. Whether or not the compression pressure is now acting upon a face of the cylinder, rather than upon a face of the shoe, is of no concern with respect to the reduction in the moment tending to turn the shoe around the cylinder. Thus the vent openings permit this form of shoe to be used under conditions in which a channel-shaped shoe without vent openings would not be satisfactory.

The force locations and directions are shown in FIG. 5 but the calculations of particular forces are omitted herein for the purpose of brevity.

Referring now to FIG. 6, an additional form which the blade and shoe may take is shown. The purpose of the arrangement shown is to provide for reduced clearance volumes and increased bearing areas relative to the forms shown in FIGS. 3 and 5.

Referring to FIG. 6, the shoe 72 has a somewhat heavier wall and a flat surface top 74 and bottom 76. The cylinder 78 on the blade 80 has a relieved area in the form of a flat 82 which is located to be in communication throughout the pivoting of the shoe 72 on the cylinder 78 with the vent openings 84 in the shoe. The remarks relating to the vent openings 70 of FIG. 5 and the resultant moments are also applicable to vent openings 84 and resultant moments in FIG. 6. The radius of the curved portions of the external wall of the shoe is slightly under half of the width of the vane slot 86 so that the diameter of the basically semi-spherical parts of the shoe approximate the vane width. As a result, the shoe in FIG. 6 fills the space in the vane slot unoccupied by the blade and shoe to a greater degree than that provided with the arrangement of FIGS. 3 and 5 and therefore reduces the clearance volume of the compressor. The reduced clearance volume reduces re-expansion losses and improves the volumetric efficiency of the compressor.

In FIG. 6, the approximate position of the shoe at maximum angular displacement is indicated by the broken line showing of the marginal edge portions of the shoes. The shoes of FIG. 6 may be made from tubing material.

What is claimed is:

1. In a rotary compressor;

a hollow housing;

a rotor in the housing having a changing curvature periphery presented to the spaces in said housing in which suction and compression take place as said rotor turns;

at least one generally radially movable vane assembly separating the spaces between the rotor periphery and the housing into a compression space and a suction space;

said vane assembly comprising a blade having a longitudinal edge of generally cylindrical-shape in transverse cross section, and a shoe carried in pivotal relation on said edge, said shoe having a socket-shaped recess within which said cylindrical-shaped edge is received and retained;

said housing includes slot means within which said vane assembly is radially movable, with a surface of said shoe bearing against said rotor periphery, the end of said vane assembly opposite said shoe being in communication with high side pressure developed by said compressor so that the force developed by said high side pressure urges said bearing surface of said shoe against said rotor periphery; and said shoe includes vent opening means only in the face thereof facing the compression space in said compressor to reduce the moment tending to tilt said shoe around said cylindrical-shaped edge.

2. In a rotary compressor according to claim 1 wherein:

said rotor is of elliptical shape.

3. In a rotary compressor according to claim 1 wherein:

said shoe is of generally channel-shape in transverse cross section and includes at least marginal edge portions of the opposite legs of the channel directed inwardly to hold said shoe on said cylindrical-shaped edge.

4. In a rotary compressor according to claim 3 wherein:

said shoe has walls of uniform thickness throughout its cross section.

5. A rotary compressor vane assembly comprising a blade and a shoe, said blade and shoe being connected to each other in pivotal cylinder and socket relation, with the shoe having a socket therein fitting on a generally cylindrical-shaped edge of said blade;

said shoe in cross section being of hollow, generally semicircular shape with an inner wall surface of circular form and an outer wall having an intermediate flattened portion and adjacent opposite curved portions having a diameter to closely fit within a vane assembly slot width dimension slightly exceeding said diameter, said shoe having vent openings only in the wall adapted to face a compression space, and said cylindrical-shaped edge having a relieved area to provide a space in communication with said vent openings along the length of said blade and shoe.

6. In a rotary compressor:

a hollow housing;

a rotor in the housing having a changing curvature periphery presented to the spaces in said housing in which suction and compression take place as said rotor turns;

at least one generally radially movable vane assembly separating the spaces between the rotor periphery and the housing into a compression space and a suction space;

said vane assembly comprising a blade having a longitudinal edge of generally cylindrical-shape in transverse cross section, and a shoe carried in pivotal relation on said edge, said shoe having a socket-shaped recess within which said cylindrical-shaped edge is received and retained;

said housing includes slot means within which said vane assembly is radially movable, with a surface of said shoe bearing against said rotor periphery;

said shoe includes vent opening means only in the face thereof facing the compression space in said compressor;

said shoe in cross section is of hollow, generally semicylindrical shape with an inner wall surface of circular form and an outer wall having an intermdiate flattened portion adapted to ride on the periphery of said rotor, and adjacent opposite curved portions having a diameter slightly less than the width of said slot in said housing to closely fit therewithin at a top center position of said rotor.

* * * * *